US007630187B2

(12) United States Patent
Lin et al.

(10) Patent No.: US 7,630,187 B2
(45) Date of Patent: Dec. 8, 2009

(54) HIGH-VOLTAGE PULSE PROTECTION DEVICE AND VIDEO APPARATUS DEPLOYMENT THEREOF

(75) Inventors: Yung-Da Lin, Chung Ho (TW); Kuo-Ying Su, Chung Ho (TW); Chih-Feng Cheng, Chung Ho (TW); Chien-Chung Chiang, Chung Ho (TW)

(73) Assignee: Avermedia Technologies, Inc., Taipei Hsien (TW)

( * ) Notice: Subject to any disclaimer, the term of this patent is extended or adjusted under 35 U.S.C. 154(b) by 570 days.

(21) Appl. No.: 11/457,568

(22) Filed: Jul. 14, 2006

(65) Prior Publication Data

US 2007/0279826 A1 Dec. 6, 2007

(30) Foreign Application Priority Data

Jun. 2, 2006 (TW) ..... 95209641 U

(51) Int. Cl.

| | |
|---|---|
| ***H02H 3/22*** | (2006.01) |
| *H01C 7/12* | (2006.01) |
| *H02H 1/00* | (2006.01) |
| *H02H 1/04* | (2006.01) |
| *H02H 9/06* | (2006.01) |

(52) U.S. Cl. ..... 361/111; 361/118; 361/119

(58) Field of Classification Search ..... 361/119, 361/111

See application file for complete search history.

(56) References Cited

U.S. PATENT DOCUMENTS

| | | | | |
|---|---|---|---|---|
| 6,385,030 | B1 * | 5/2002 | Beene | 361/119 |
| 7,170,728 | B2 * | 1/2007 | Mueller | 361/56 |

* cited by examiner

*Primary Examiner*—Albert W Paladini
*Assistant Examiner*—Dharti Patel

(57) ABSTRACT

A high-voltage pulse protection device includes an input connector, a separating capacitor and an output connector. A video receiving terminal of the input connector receives a video signal from a RF cable. An input terminal of the separating capacitor is electrically connected to a video transferring terminal of the input connector to receive the video signal. An output terminal of the separating capacitor induces and outputs a sub-signal response to the video signal. A video receiving terminal of the output connector receives the sub-signal, and a video transferring terminal of the output connector transfers the sub-signal to a video processing module.

34 Claims, 2 Drawing Sheets

HIGH-VOLTAGE PULSE PROTECTION DEVICE AND VIDEO APPARATUS DEPLOYMENT THEREOF

RELATED APPLICATIONS

The present application is based on, and claims priority from, Taiwan Application Serial Number 95209641, filed Jun. 2, 2006, the disclosure of which is hereby incorporated by reference herein in its entirety.

BACKGROUND

1. Field of Invention

The present invention relates to a high-voltage pulse protection device. More particularly, the present invention relates to a high-voltage pulse protection device for a video apparatus.

2. Description of Related Art

Lightning bolts are natural phenomenon. Each lightning bolt has a voltage between one hundred million volts and one billion volts and has a current between twenty thousand amperes and forty thousand amperes. Therefore, if an electrical apparatus without proper insulation is struck by lightning, the electrical apparatus will be seriously damaged.

A typical video apparatus or display apparatus (such as a digital/analog TV turner, a digital/analog TV card/box, a plasma/LCD TV, a hand-held mobile TV, a set-top box, a high definition TV, a digital TV receiver, a satellite TV card/box, a car TV, a TV signal transmitter, a DVD player, a video tape player/recorder, a security video system, an internet security video system or a traffic video system) has an input terminal, a video processing module, and a cable. The input terminal (such as an antenna) receives a TV signal. The cable connects the input terminal and the video processing module to transfer the TV signal to the video processing module.

When lightning strikes the input terminal, the high voltage current from the lightning bolt passes through the cable and also damages the video processing module. For example, when an antenna located on a rooftop is struck by lightning, the high voltage current from the lightning bolt passes through the antenna cable and also damages the TV located in the house. Furthermore, a user may be severely injured by the lightning if he/she touches one of the TV conductors.

How to provide a device to protect the video apparatus from being damaged by high voltage currents induced by lightning strikes and other high-voltage pulses is what both manufacturers and users are longing for.

SUMMARY

It is therefore an aspect of the present invention to provide a high-voltage pulse protection device with a separating capacitor to protect the video apparatus from high-voltage pulses. The separating capacitor separates the high-voltage pulses from the video signal. Therefore, high-voltage pulses are prevented from striking the video processing module connected to the high-voltage pulse protection device.

According to one preferred embodiment of the present invention, a high-voltage pulse protection device includes an input connector, a separating capacitor and an output connector. The video receiving terminal of the input connector receives a video signal from a RF cable. The input terminal of the separating capacitor is electrically connected to the video transferring terminal of the input connector and receives the video signal. The output terminal of the separating capacitor induces and outputs a sub-signal response to the video signal.

The video receiving terminal of the output connector receives the sub-signal, and the video transferring terminal of the output connector transfers the sub-signal to a video processing module. Furthermore, the ground of the input connector is electrically connected to the ground of the output connector.

According to another preferred embodiment of the present invention, a high-voltage pulse protection device includes an input connector, a separating capacitor, a first ground capacitor and an output connector. The video receiving terminal of the input connector receives a video signal from a RF cable. The input terminal of the separating capacitor is electrically connected to the video transferring terminal of the input connector and receives the video signal. The output terminal of the separating capacitor induces and outputs a sub-signal response to the video signal. The video receiving terminal of the output connector receives the sub-signal, and the video transferring terminal of the output connector transfers the sub-signal to a video processing module. Furthermore, the input terminal of the first ground capacitor is electrically connected to the first ground of the input connector, and the output terminal of the first ground capacitor is electrically connected to the first ground of the output connector to enhance the protection from high-voltage pulses.

According to still another preferred embodiment of the present invention, a video apparatus is provided. The video apparatus includes a video processing module and a high-voltage pulse protection device. The high-voltage pulse protection device has a separating capacitor. The input terminal of the separating capacitor receives a video signal. The output terminal of the separating capacitor induces a sub-signal response to the video signal and outputs the sub-signal to the video processing module.

According to yet another preferred embodiment of the present invention, a video apparatus is provided. The video apparatus includes a video processing module and a high-voltage pulse protection device. The high-voltage pulse protection device has a separating capacitor and a first ground capacitor. The input terminal of the separating capacitor receives a video signal from a video input terminal. The output terminal of the separating capacitor induces a sub-signal response to the video signal and outputs the sub-signal to the video processing module. Furthermore, the input terminal of the first ground capacitor is electrically connected to the first ground of the video input terminal, and the output terminal of the first ground capacitor is electrically connected to the first ground of a video output terminal to enhance the protection from high-voltage pulses.

In conclusion, the high-voltage pulse protection device according to the above mentioned embodiments protects the video processing module from being struck by the high-voltage pulses (such as lightning). Furthermore, the high-voltage pulse protection device has the ability to transfer the video signal to the video processing module. In addition, because the high-voltage pulse protection device according to the above mentioned embodiments protects the video processing module from the high-voltage pulses, users who use the high-voltage pulse protection device can be prevented from getting injured by the high-voltage pulses.

It is to be understood that both the foregoing general description and the following detailed description are by examples, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
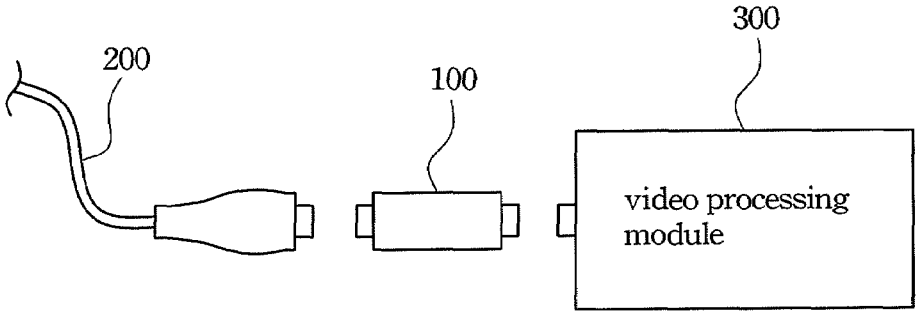
FIG. 1 is a diagram showing how a high-voltage pulse protection device according to one preferred embodiment of this invention is connected to a video processing module.

Reference will now be made in detail to the present preferred embodiments of the invention, examples of which are illustrated in the accompanying drawings. Wherever possible, the same reference numbers are used in the drawings and the description to refer to the same or like parts.

Reference is made to FIG. 1. FIG. 1 shows how a high-voltage pulse protection device according to one preferred embodiment of this invention is connected to a video processing module. In FIG. 1, a high-voltage pulse protection device 100 is electrically connected between a RF cable 200 and a video processing module 300. In other words, the high-voltage pulse protection device 100 is external to the video processing module 300 for easy disassembly and reassembly.

Figure 2:
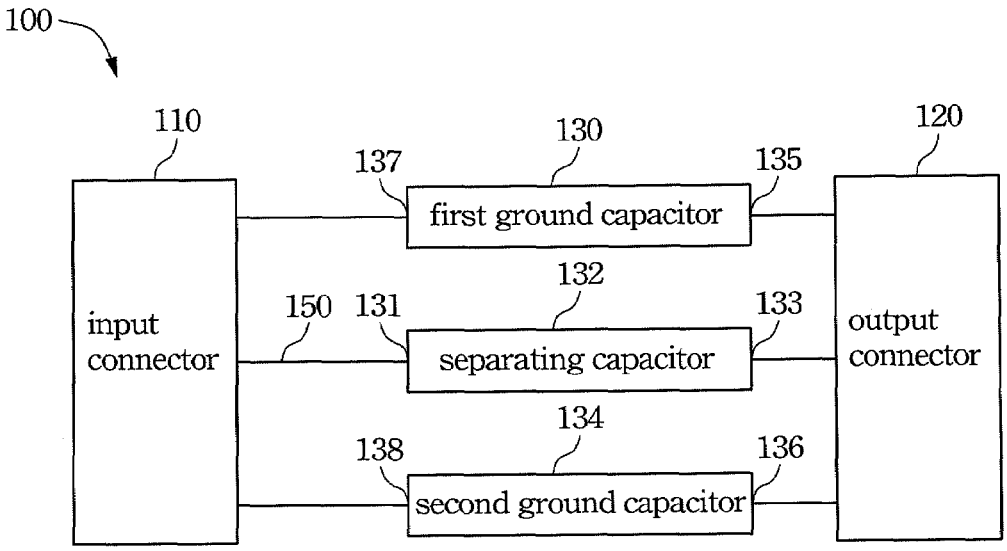
FIG. 2 is a block diagram of the high-voltage pulse protection device 100 shown in FIG. 1.
Figure 3:
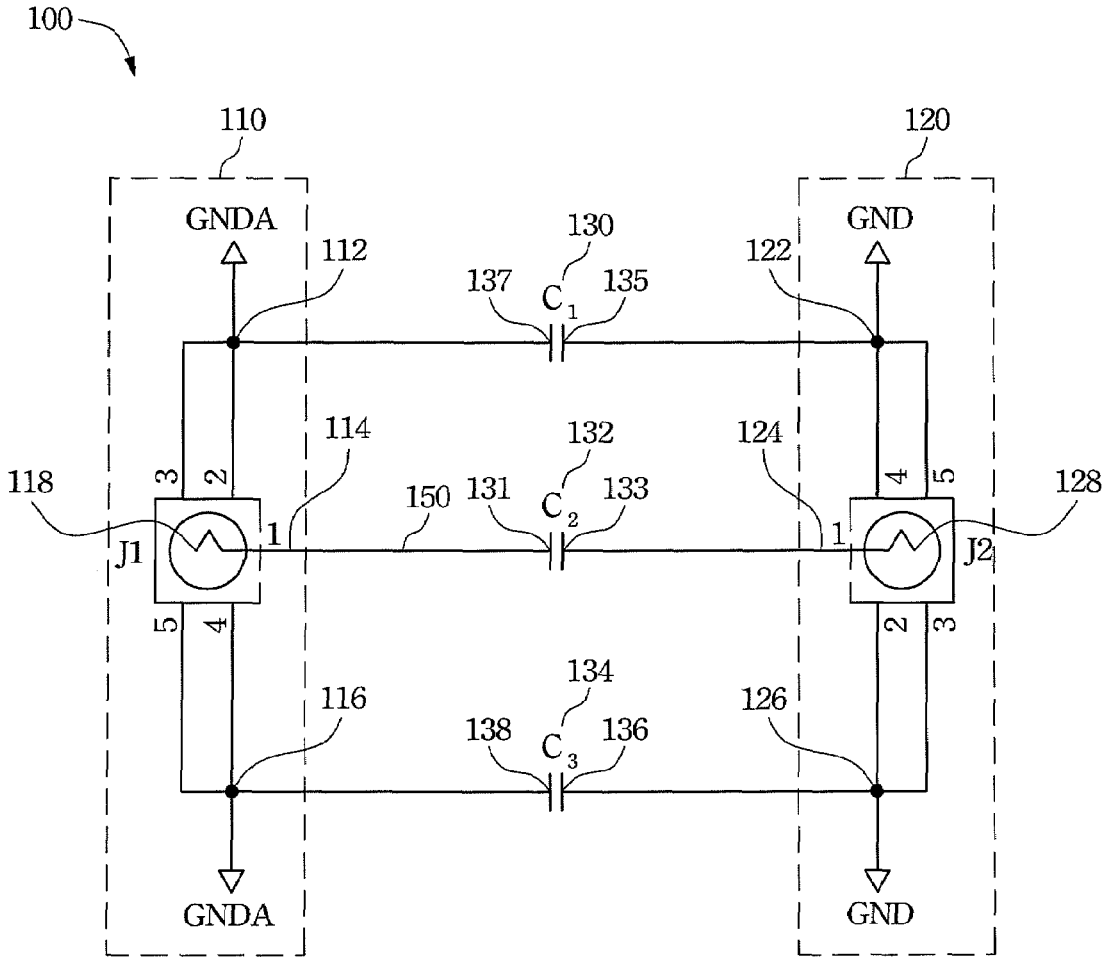
FIG. 3 is a detailed circuit diagram of the high-voltage pulse protection device 100 shown in FIG. 1.

Reference is made to FIG. 2 and FIG. 3. FIG. 2 is a block diagram of the high-voltage pulse protection device 100 shown in FIG. 1, and FIG. 3 is a detailed circuit diagram of the high-voltage pulse protection device 100 shown in FIG. 1. The high-voltage pulse protection device 100 includes an input connector 110, a separating capacitor 132 and an output connector 120. The video receiving terminal 118 of the input connector 110 receives a video signal from the RF cable 200 (shown in FIG. 1). The input terminal 131 of the separating capacitor 132 is electrically connected to the video transferring terminal 114 of the input connector 110 to receive the video signal. The output terminal 133 of the separating capacitor 132 induces and outputs a sub-signal response to the video signal. The video receiving terminal 124 of the output connector 120 receives the sub-signal, and the video transferring terminal 128 of the output connector 120 transfers the sub-signal to the video processing module 300 (shown in FIG. 1). The separating capacitor 132 separates the high-voltage pulses from the video signal and transfers the sub-signal, which has had all the high-voltage pulses filtered out, to the video processing module. Therefore, high-voltage pulses are prevented from striking the video processing module.

In order to enhance the protection effect from the high-voltage pulses, the high-voltage pulse protection device 100 may have a first ground capacitor 130. The input terminal 137 of the first ground capacitor 130 is electrically connected to the first ground 112 of the input connector 110, and the output terminal 135 of the first ground capacitor 130 is electrically connected to the first ground 122 of the output connector 120. Moreover, the high-voltage pulse protection device 100 according to the present embodiment may have a second ground capacitor 134. The input terminal 138 of the second ground capacitor 134 is electrically connected to the second ground 116 of the input connector 110, and the output terminal 136 of the second ground capacitor 134 is electrically connected to the second ground 126 of the output connector 120. The first ground capacitor 130 and the second ground capacitor 134 enhance the protection from damage by high-pulse voltages by isolating the ground of the input connector 110 from the ground of the output connector 120. Besides, the ground of the input connector may be electrically connected to the ground of the output connector directly as well.

The clearance distance from the input terminal 131 of the separating capacitor 132 to the output terminal 135 of the first ground capacitor 130 and the output terminal 136 of the second ground capacitor 134 may be equal to or larger than 0.4 mm. In addition, the clearance distance from the input terminal 131 of the separating capacitor 132 to the ground of the input connector 110 (such as the first ground 112 and the second ground 116 of the input connector 110) may be equal to or larger than 0.4 mm as well to prevent the high-voltage pulse protection device 100 from electricity going off line when damaged by lightning or high-voltage pulses. However, clearance distance limitations are relaxed if an insulator isolates the separating capacitor 132 from the first ground capacitor 130, the second ground capacitor 134 and the ground of the input connector 110. For example, if the separating capacitor 132, the first ground capacitor 130 and the second ground capacitor 134 are covered with insulating materials, the clearance distance from the input terminal 131 of the separating capacitor 132 to the output terminal 135 of the first ground capacitor 130, the output terminal 136 of the second ground capacitor 134 and the ground of the input connector 110 is equal to or larger than 0.08 mm.

The high-voltage pulse protection device 100 may further include a video conducting wire 150. The video conducting wire 150 electrically connects the video transferring terminal 114 of the input connector 110 and the input terminal 131 of the separating capacitor 132. The clearance distance from the video conducting wire 150 to the ground of the input connector 110 (such as the case of the input connector 110, the first ground 112 of the input connector 110 and the second ground 116 of the input connector 110) may be equal to or larger than 0.4 mm to prevent the high-voltage pulse protection device 100 from electricity going off line when damaged by lightning or high-voltage pulses.

Similarly, the clearance distance limitations are relaxed if an insulator isolates the video conducting wire 150 from the ground of the input connector 110. For example, if the video conducting wire 150 is covered insulating materials, the clearance distance from the video conducting wire 150 to the ground of the input connector 110 may be equal to or larger than 0.08 mm.

In order to have excellent protection against damage from lightning or high-voltage pulses, the clearance distance between the input connector 110 and the output connector 120 may be equal to or larger than 0.4 mm, and the creepage distance between the input connector 110 and the output connector 120 may be larger than 0.6 mm. The distance limitations are determined by the safety requirements. If the safety requirements are higher, the distance between the input connector 110 and the output connector 120 should be larger as well.

More specifically, the distance between the input terminal 131 and the output terminal 133 of the separating capacitor 132 may be equal to or larger than 0.4 mm. Moreover, the distance between the input terminal 137 and the output terminal 135 of the first ground capacitor 130 and the distance between the input terminal 138 and the output terminal 136 of the second ground capacitor 134 may be equal to or larger than 0.4 mm as well. Similarly, the distance limitations are determined by the safety requirements. If the safety requirements are higher, the distance between the input connector 110 and the output connector 120 should be larger.

However, vision quality is directly related to the intensity of the video signal. In order to prevent video signal intensity decay between the video signal and the sub-signal, the distance between the input terminal 131 and the output terminal 133 of the separating capacitor 132 may be equal to or smaller than 5.6 mm in this embodiment. Moreover, the distance between the input terminal 137 and the output terminal 135 of the first ground capacitor 130 and the distance between the input terminal 138 and the output terminal 136 of the second ground capacitor 134 may be equal to or smaller than 5.6 mm as well. Following the mentioned distance limitations, the high-voltage pulse protection device 100 does not only have excellent protecting effects against damage from lightning or high-voltage pulses, but video signal intensity decay between the video signal and the sub-signal can be eliminated.

If the ground of the input connector 110 (such as the first ground 112 or the second ground 116 of the input connector 110) is electrically connected to a ground potential, the mentioned distance limitations are relaxed. For example, if the first ground 112 or the second ground 116 of the input connector 110 is electrically connected to a ground potential, the distance between the input terminal 131 and the output terminal 133 of the separating capacitor 132 can be smaller than 0.4 mm or larger than 5.6 mm.

In addition, in order to ensure the protecting effect and increase the reliability, the voltage endurance of the separating capacitor 132, the first ground capacitor 130 and/or the second ground capacitor 134 may be larger than 1 KV. The voltage endurance test time of the separating capacitor 132, the first ground capacitor 130 and/or the second ground capacitor 134 may be equal to or larger than 60 seconds.

In this embodiment, the input connector 110, the separating capacitor 132, the output connector 120, the first ground capacitor 130 and the second ground capacitor 134 may be mounted on a printed circuit board. However, the input connector and the output connector may also be an input terminal and an output terminal, and the separating capacitor, the first ground capacitor and the second ground capacitor may be directly welded onto the input terminal and the output terminal and the printed circuit board may not be required.

Another embodiment of the present invention provides a video apparatus employing the high-voltage pulse protection device. In this embodiment, the high-voltage pulse protection device is built in the video apparatus. In other words, the separating capacitor, the first ground capacitor and the second ground capacitor may be electrically connected to the video processing module directly. For example, the separating capacitor, the first ground capacitor and the second ground capacitor may be mounted on the same printed circuit broad the video processing module is mounted and be electrically connected to the video processing module directly.

The following provides examples to show the efficiency of the high-voltage pulse protection device according to the mentioned embodiments:

Example I

Reference is made to FIG. 3. In this example, an AC power source and a current meter is electrically connected to the ground of the input connector 110 (such as the first ground 112 or the second ground 116 of the input connector 110) and the ground of the output connector 120 (such as the first ground 122 or the second ground 126 of the output connector 120) to test if current passes from the ground of the input connector 110 to the ground of the output connector 120 when the input connector 110 is struck by high-voltage pulses. If current passes, the high-voltage pulses will damage the video processing module. If current does not pass through, the high-voltage pulse protection device according to this example can provide proper protecting effects against damage from lightning or high-voltage pulses.

The AC power source provides a power output of 1500 V to the ground of the input connector 110 for sixty seconds to simulate the high-voltage pulses hitting the input connector 110 during testing. At the same time, the current meter measures the current passing from the ground of the input connector 110 to the ground of the output connector 120. The measured result shows that a current of less than 10 mA passes from the ground of the input connector 110 to the ground of the output connector 120. That is, there is no danger of current passing from the ground of the input connector 110 to the ground of the output connector 120.

Example II

In this example, the AC power source in example I is replaced by a DC power source. The DC power source provides a power output of 500 V to the ground of the input connector 110 for sixty seconds to simulate high-voltage pulses hitting the input connector 110 during testing. At the same time, the current meter measures the current passing from the ground of the input connector 110 to the ground of the output connector 120. The measured result shows that a current of less than 10 mA passes from the ground of the input connector 110 to the ground of the output connector 120. That is, there is no danger of current passing from the ground of the input connector 110 to the ground of the output connector 120.

In conclusion, whether the input connector 110 is hit by direct current or alternating current, the high-voltage pulse protection device according to the mentioned examples can protect the video apparatus from high-voltage pulses, that is, there is no danger of current passing from the ground of the input connector 110 to the ground of the output connector 120.

The invention has at least the following advantages:

(1) The high-voltage pulse protection device according to the mentioned embodiments protects the video processing module from being struck by high-voltage pulses (such as lightning). Furthermore, the high-voltage pulse protection device has the ability to transfer the video signal to the video processing module as well.

(2) Because the high-voltage pulse protection device according to the mentioned embodiments protects the video processing module from high-voltage pulses, users, who use the video apparatus on which the high-voltage pulse protection device is applied, can be saved from injuries incurred by the high-voltage pulses.

(3) Because the high-voltage pulse protection device according to the mentioned embodiments can be prevented from the electricity going off line when suffering lightning damage or high-voltage pulses, the high-voltage pulse protection device can provides more perfect protection to the users.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A high-voltage pulse protection device, comprising:

an input connector having a ground, a video transferring terminal and a video receiving terminal for receiving a video signal from a RF cable;

a separating capacitor having an input terminal electrically connected to the video transferring terminal of the input connector for receiving the video signal and an output terminal for inducing and outputting a sub-signal response to the video signal, wherein the input terminal of the separating capacitor is isolated from the ground of the input connector; and an output connector having a ground, a video receiving terminal for receiving the sub-signal and a video transferring terminal for transferring the sub-signal to a video processing module, wherein the ground of the input connector is electrically connected to the ground of the output connector.

2. The high-voltage pulse protection device of claim 1, wherein the input terminal of the separating capacitor is spaced from the ground of the input connector at a clearance distance equal to or larger than about 0.4 mm.

3. The high-voltage pulse protection device of claim 1, wherein the input terminal of the separating capacitor is isolated from the ground of the input connector by an insulator, and the input terminal of the separating capacitor is spaced from the ground of the input connector at a clearance distance equal to or larger than about 0.08 mm.

4. The high-voltage pulse protection device of claim 1, further comprising a video conducting wire electrically connecting the video transferring terminal of the input connector and the input terminal of the separating capacitor, wherein the video conducting wire is spaced from the ground of the input connector at a clearance distance equal to or larger than about 0.4 mm.

5. The high-voltage pulse protection device of claim 1, further comprising a video conducting wire electrically connecting the video transferring terminal of the input connector and the input terminal of the separating capacitor, wherein the video conducting wire is isolated from the ground of the input connector by an insulator, and the video conducting wire is spaced from the ground of the input connector at a clearance distance equal to or larger than about 0.08 mm.

6. The high-voltage pulse protection device of claim 1, wherein the input terminal of the separating capacitor is spaced from the output terminal of the separating capacitor at a distance equal to or larger than about 0.4 mm.

7. The high-voltage pulse protection device of claim 1, wherein the input terminal of the separating capacitor is spaced from the output terminal of the separating capacitor at a distance equal to or smaller than about 5.6 mm.

8. The high-voltage pulse protection device of claim 1, wherein the separating capacitor has a voltage endurance larger than 1 KV.

9. A high-voltage pulse protection device, comprising:

an input connector having a first ground, a video transferring terminal and a video receiving terminal for receiving a video signal from a RF cable;

a separating capacitor having an input terminal electrically connected to the video transferring terminal of the input connector for receiving the video signal and an output terminal for inducing and outputting a sub-signal response to the video signal;

an output connector having a first ground, a video receiving terminal for receiving the sub-signal and a video transferring terminal for transferring the sub-signal to a video processing module; and a first ground capacitor having an input terminal electrically connected to the first ground of the input connector and an output terminal electrically connected to the first ground of the output connector.

10. The high-voltage pulse protection device of claim 9, further comprising a second ground capacitor having an input terminal and an output terminal, wherein the input connector further has a second ground, the output connector further has a second ground, the input terminal of the second ground capacitor is electrically connected to the second ground of the input connector, and the output terminal of the second ground capacitor is electrically connected to the second ground of the output connector.

11. The high-voltage pulse protection device of claim 10, wherein the input terminal of the separating capacitor is spaced from the output terminal of the second ground capacitor at a clearance distance equal to or larger than about 0.4 mm.

12. The high-voltage pulse protection device of claim 10, wherein the input terminal of the separating capacitor is isolated from the output terminal of the second ground capacitor by an insulator, and the input terminal of the separating capacitor is spaced from the output terminal of the second ground capacitor at a clearance distance equal to or larger than about 0.08 mm.

13. The high-voltage pulse protection device of claim 10, wherein the input terminal of the separating capacitor is spaced from the output terminal of the separating capacitor at a distance equal to or larger than about 0.4 mm, the input terminal of the first ground capacitor is spaced from the output terminal of the first ground capacitor at a distance equal to or larger than about 0.4 mm, and the input terminal of the second ground capacitor is spaced from the output terminal of the second ground capacitor at a distance equal to or larger than about 0.4 mm.

14. The high-voltage pulse protection device of claim 10, wherein the input terminal of the separating capacitor is spaced from the output terminal of the separating capacitor at a distance equal to or smaller than about 5.6 mm, the input terminal of the first ground capacitor is spaced from the output terminal of the first ground capacitor at a distance equal to or smaller than about 5.6 mm, and the input terminal of the second ground capacitor is spaced from the output terminal of the second ground capacitor at a distance equal to or smaller than about 5.6 mm.

15. The high-voltage pulse protection device of claim 9, wherein the input terminal of the separating capacitor is spaced from the output terminal of the first ground capacitor at a clearance distance equal to or larger than about 0.4 mm.

16. The high-voltage pulse protection device of claim 9, wherein the input terminal of the separating capacitor is isolated from the output terminal of the first ground capacitor by an insulator, and the input terminal of the separating capacitor is spaced from the output terminal of the first ground capacitor at a clearance distance equal to or larger than about 0.08 mm.

17. The high-voltage pulse protection device of claim 9, wherein the separating capacitor has a voltage endurance larger than 1 KV.

18. A video apparatus, comprising:

a video processing module; and a high-voltage pulse protection device comprising:

an input connector having a ground, a video transferring terminal and a video receiving terminal for receiving a video signal from a RF cable; and a separating capacitor having an input terminal for receiving the video signal and an output terminal for inducing and outputting a sub-signal response to the video signal to the video processing module, wherein the input terminal of the separating capacitor is isolated from the ground of the input connector.

19. The video apparatus of claim 18, wherein the input terminal of the separating capacitor is spaced from the ground of the input connector at a clearance distance equal to or larger than about 0.4 mm.

20. The video apparatus of claim 18, wherein the input terminal of the separating capacitor is isolated from the ground of the input connector by an insulator, and the input terminal of the separating capacitor is spaced from the ground of the input connector at a clearance distance equal to or larger than about 0.08 mm.

21. The video apparatus of claim 18, further comprising a video conducting wire electrically connecting the video transferring terminal of the input connector and the input terminal of the separating capacitor, wherein the video conducting wire is spaced from the ground of the input connector at a clearance distance equal to or larger than about 0.4 mm.

22. The video apparatus of claim 18, further comprising a video conducting wire electrically connecting the video transferring terminal of the input connector and the input terminal of the separating capacitor, wherein the video conducting wire is isolated from the ground of the input connector by an insulator, and the video conducting wire is spaced from the ground of the input connector at a clearance distance equal to or larger than about 0.08 mm.

23. The video apparatus of claim 18, wherein the input terminal of the separating capacitor is spaced from the output terminal of the separating capacitor at a distance equal to or larger than about 0.4 mm.

24. The video apparatus of claim 18, wherein the input terminal of the separating capacitor is spaced from the output terminal of the separating capacitor at a distance equal to or smaller than about 5.6 mm.

25. The video apparatus of claim 18, wherein the separating capacitor has a voltage endurance larger than 1 KV.

26. A video apparatus, comprising:

a video processing module; and a high-voltage pulse protection device comprising:

a separating capacitor having an input terminal for receiving a video signal from a video input terminal and an output terminal for inducing and outputting a sub-signal response to the video signal to the video processing module; and a first ground capacitor having an input terminal electrically connected to a first ground of the video input terminal and an output terminal electrically connected to a first ground of a video output terminal.

27. The video apparatus of claim 26, further comprising a second ground capacitor having an input terminal electrically connected to a second ground of the video input terminal and an output terminal electrically connected to a second ground of the video output terminal.

28. The video apparatus of claim 27, wherein the input terminal of the separating capacitor is spaced from the output terminal of the second ground capacitor at a clearance distance equal to or larger than about 0.4 mm.

29. The video apparatus of claim 27, wherein the input terminal of the separating capacitor is isolated from the output terminal of the second ground capacitor by an insulator, and the input terminal of the separating capacitor is spaced from the output terminal of the second ground capacitor at a clearance distance equal to or larger than about 0.08 mm.

30. The video apparatus of claim 27, wherein the input terminal of the separating capacitor is spaced from the output terminal of the separating capacitor at a distance equal to or larger than about 0.4 mm, the input terminal of the first ground capacitor is spaced from the output terminal of the first ground capacitor at a distance equal to or larger than about 0.4 mm, and the input terminal of the second ground capacitor is spaced from the output terminal of the second ground capacitor at a distance equal to or larger than about 0.4 mm.

31. The video apparatus of claim 27, wherein the input terminal of the separating capacitor is spaced from the output terminal of the separating capacitor at a distance equal to or smaller than about 5.6 mm, the input terminal of the first ground capacitor is spaced from the output terminal of the first ground capacitor at a distance equal to or smaller than about 5.6 mm, and the input terminal of the second ground capacitor is spaced from the output terminal of the second ground capacitor at a distance equal to or smaller than about 5.6 mm.

32. The video apparatus of claim 26, wherein the input terminal of the separating capacitor is spaced from the output terminal of the first ground capacitor at a clearance distance equal to or larger than about 0.4 mm.

33. The video apparatus of claim 26, wherein the input terminal of the separating capacitor is isolated from the output terminal of the first ground capacitor by an insulator, and the input terminal of the separating capacitor is spaced from the output terminal of the first ground capacitor at a clearance distance equal to or larger than about 0.08 mm.

34. The video apparatus of claim 26, wherein the separating capacitor has a voltage endurance larger than 1 KV.

* * * * *